US009051527B2

(12) United States Patent
Morton et al.

(10) Patent No.: US 9,051,527 B2
(45) Date of Patent: Jun. 9, 2015

(54) FUEL OIL COMPOSITIONS

(75) Inventors: Colin Morton, Oxfordshire (GB); Robert D. Tack, Oxfordshire (GB); Philip D. Armitage, Oxfordshire (GB); Carlo S. Fava, Oxfordshire (GB); Viral B. Patel, Oxfordshire (GB)

(73) Assignee: Infineum International Limited, Abingdon, Oxfordshire (GB)

( * ) Notice: Subject to any disclaimer, the term of this patent is extended or adjusted under 35 U.S.C. 154(b) by 1133 days.

(21) Appl. No.: 11/351,024

(22) Filed: Feb. 9, 2006

(65) Prior Publication Data

US 2006/0196109 A1 Sep. 7, 2006

(30) Foreign Application Priority Data

Feb. 11, 2005 (EP) ..... 05250780

(51) Int. Cl.

| | |
|---|---|
| ***C10L 1/18*** | (2006.01) |
| ***C10L 10/14*** | (2006.01) |
| ***C10L 1/14*** | (2006.01) |
| ***C10L 1/197*** | (2006.01) |

(52) U.S. Cl.

CPC ..... *C10L 10/14* (2013.01); *C10L 1/143* (2013.01); *C10L 1/1973* (2013.01)

(58) Field of Classification Search

CPC ..... C10L 1/143; C10L 1/1973; C10L 10/14; Y10T 156/1751; Y10T 156/178; Y10T 156/1798; B56C 1/04

USPC ..... 44/393, 395; 524/523

See application file for complete search history.

(56) References Cited

U.S. PATENT DOCUMENTS

| | | | | |
|---|---|---|---|---|
| 4,147,520 | A | 4/1979 | Ilnyckyj | |
| 4,211,534 | A | 7/1980 | Feldman | |
| 5,833,722 | A * | 11/1998 | Davies et al. | 44/418 |
| 6,143,044 | A * | 11/2000 | Davies et al. | 44/393 |
| 2004/0010072 | A1* | 1/2004 | Krull et al. | 524/523 |

FOREIGN PATENT DOCUMENTS

| | | | |
|---|---|---|---|
| EP | 153176 | 8/1985 | |
| EP | 153177 | 8/1985 | |
| EP | 225688 | 9/1986 | |
| EP | 327427 | 8/1989 | |
| EP | 1007606 | 6/2000 | |
| EP | 1 491 614 A1 | 12/2004 | C10L 1/18 |
| WO | 91/11488 | 8/1991 | |
| WO | 91/16407 | 10/1991 | |
| WO | 93/04148 | 3/1993 | |
| WO | 96/07718 | 3/1996 | |
| WO | 96/07720 | 3/1996 | C10L 1/18 |
| WO | 99/07809 | 2/1999 | C10L 1/18 |
| WO | 99/07810 | 2/1999 | |
| WO | 03/042337 A2 | 3/2003 | C10L 1/18 |

OTHER PUBLICATIONS

Platé, N.A. et al: "Comb-Like Polymers, Structure and Properties," J. Poly. Sci. Macromolecular Revs., 8, pp. 117-253 (1974).

Coley, T. et al., *Journal of the Institute of Petroleum*, entitled: "New laboratory tests for predicting low temperature operability of diesel fuel", 52(510), pp. 173-189, Jun. 1966.

* cited by examiner

*Primary Examiner* — James Goloboy
*Assistant Examiner* — Latosha Hines
(74) *Attorney, Agent, or Firm* — Kenyon & Kenyon LLP

(57) ABSTRACT

A fuel oil composition comprises a fuel oil in a major amount, which fuel oil has a mass % against n-alkane carbon number distribution curve characterised by:

(i) a maximum negative gradient from carbon number 18 to carbon number 26 that is less than −0.30; and (ii) a ratio of the mass of n-alkanes of carbon number greater than 22 to the mass of n-alkanes from carbon number 18 to carbon number 21 that does not exceed 0.25; and an additive in a minor amount, which additive comprises at least one ethylene polymer which, in addition to units derived from ethylene, comprises units of the formula (I):

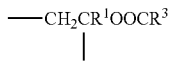

(I)

and, optionally, units of the formula (II):

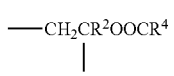

(II)

wherein each $R^1$ group and each $R^2$ group independently represents hydrogen or methyl;

each $R^3$ group independently represents an alkyl group having 5 or more carbon atoms; and each $R^4$ group independently represents an alkyl group having from 1 to 4 carbon atoms, and wherein the proportion of units of formula (I) in the or each ethylene polymer is greater than 13 and not greater than 20 mole percent, and the total proportion of units of formula (I) and of formula (II) in the or each ethylene polymer is greater than 13 and not greater than 25 mole percent.

7 Claims, No Drawings

FUEL OIL COMPOSITIONS

This invention relates to fuel oil compositions susceptible to wax formation at low temperatures.

Fuel oils, whether derived from petroleum or from vegetable sources, contain components, e.g., n-alkanes or methyl n-alkanoates, that at low temperature tend to precipitate as large, plate-like crystals or spherulites of wax in such a way as to form a gel structure which causes the fuel to lose its ability to flow. The lowest temperature at which the fuel will still flow is known as the pour point.

As the temperature of the fuel falls and approaches the pour point, difficulties arise in transporting the fuel through lines and pumps. Further, the wax crystals tend to plug fuel lines, screens, and filters at temperatures above the pour point. These problems are well-recognised in the art, and various additives have been proposed, many of which are in commercial use, for depressing the pour point of fuel oils. Similarly, other additives have been proposed and are in commercial use for reducing the size and changing the shape of the wax crystals that do form. Smaller size crystals are desirable since they are less likely to clog a filter. The wax from a diesel fuel, which is primarily n-alkane wax, crystallizes as platelets; certain additives inhibit this and cause the wax to adopt an acicular habit, the resulting needles being more likely to pass through a filter, or form a porous layer of crystals on the filter, than are platelets. The additives may also have the effect of retaining the wax crystals in suspension in the fuel, reducing settling and thus also assisting in prevention of blockages. Such wax crystal modifying additives for use in middle-distillate fractions (e.g. jet fuel, heating oil or diesel fuel) are known as middle-distillate flow improvers (MDFI's).

Effective wax crystal modification (as measured by cold filter plugging point (CFPP) and other operability tests, as well as simulated and field performance) may be achieved by ethylene-vinyl acetate (EVAC) or propionate copolymer-based flow improvers.

WO 96/07718 discloses oil-soluble ethylene terpolymers containing ethylene units and different vinyl ester units, and their use as additives for improving the low temperature flow properties of fuel oil compositions. Polymer examples 1 to 4 are ethylene-vinyl acetate-vinyl 2-ethyl hexanoate terpolymers having various proportions of the two unsaturated esters, as well as differing number average molecular weights and branching characteristics. The polymers described in WO 96/07718 are effective low temperature flow improvers.

Although the flow improves described above are largely effective, a problem in their application is their reduced effectiveness in certain types of fuel such as those in which the C17 to 21 n-alkane distribution is raised and that above C22 is lowered. The present invention overcomes this problem, as evidenced by the examples in this specification, by employing ethylene polymers in which the molar percentage of units therein is carefully controlled.

Thus, in a first aspect, the invention provides a fuel oil composition comprising (A) a fuel oil in a major amount, which fuel oil has a mass % against n-alkane carbon number distribution curve, wherein n-alkane includes any ester having the same melting point as an n-alkane, characterised by:

(i) a gradient from carbon number 18 to carbon number 26 that is less than −0.30, such as less than −0.35, such as less than −0.5; and (ii) a ratio of the mass of n-alkanes of carbon number greater than 22 to the mass of n-alkanes from carbon number 18 to carbon number 21 that does not exceed 0.25, such as not exceeding 0.20 or 0.10; and (B) an additive in a minor amount, which additive comprises at least one ethylene polymer which, in addition to units derived from ethylene, comprises units of the formula (I):

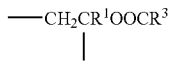

(I)

and, optionally, units of the formula (II):

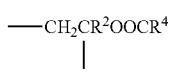

(II)

wherein each $R^1$ group and each $R^2$ group independently represents hydrogen or methyl;

each $R^3$ group independently represents an alkyl group having 5 or more carbon atoms; and each $R^4$ group independently represents an alkyl group having from 1 to 4 carbon atoms, and wherein the proportion of units of formula (I) in the or each ethylene polymer is greater than 13 and not greater than 20 mole percent and the total proportion of units of formula (I) and of formula (II) in the or each ethylene polymer is greater than 13 and not greater than 25 mole percent.

In one embodiment the fuel oil comprises a middle-distillate fuel in admixture with a vegetable-based fuel, or with a Fischer-Tropsch synthetic fuel, or with a hydrocracked vegetable fuel.

In another embodiment the fuel oil comprises a middle-distillate fuel having 10 ppm by mass or less of sulphur, expressed as atoms of sulphur.

In a second aspect the invention provides the use of an additive, as defined in the first aspect of the invention in a fuel oil, as defined in any of the first, second or third aspects of the invention, to improve the low temperature properties of the oil.

In this specification, the following words and expressions, if and when used, shall have the meanings as described below:

"active ingredient" or "(a.i.)" refers to additive material that is not diluent or solvent;

"comprising" or any cognate word specifies the presence of stated features, steps, or integers or components, but does not preclude the presence or addition of one or more other features, steps, integers, components or groups thereof;

the expressions "consists of" or "consists essentially of" or cognates may be embraced within "comprises" or cognates, wherein "consists essentially of" permits inclusion of substances not materially affecting the characteristics of the composition to which it applies;

"major amount" means in excess of 50 mass % of a composition;

"minor amount" means less than 50 mass % of a composition;

Also, it will be understood that various components used, essential as well as optional and customary, may react under conditions of formulation, storage or use and that the invention also provides the product obtainable or obtained as a result of any such reaction.

Further, it is understood that any upper and lower quantity, range and ratio limits set forth herein may be independently combined.

The features of the invention relating where appropriate to each and all aspects of the invention will now be described in more detail as follows:

Fuel Oil

The fuel oils with which this invention is concerned are those as defined above in respect of various aspects of the invention. Without wishing to be bound by any theory, the definitions are discussed below.

N-alkanes that separate in the wax on cooling a fuel oil mostly have carbon numbers greater than 17. It is observed that fuel oils become more difficult to treat, as indicated by CFPP testing, as the negative gradient of mass % against n-alkane carbon number plot, i.e. the distribution curve, for n-alkanes of carbon number greater than 17 becomes steeper. Such a distribution curve may, for example, arise from sharper, more efficient fractionation of the diesel fraction in the distillation tower. Characteristic (i) of the fuel oil as set out above, i.e. the maximum negative gradient, may be determined by fitting the part of the distribution curve representing carbon numbers 18 to 26 with a third order polynomial and taking the maximum negative gradient, i.e. d(mass %)/d(carbon number), of that part of the curve as the representative value.

Characteristic (ii) of the fuel oil expresses the ratio of the mass of higher n-alkanes to the mass of the bulk of n-alkanes that separate as wax. This ratio is significant because nuclei for the wax crystals are formed by the higher n-alkanes in the fuel for the bulk of the wax. Thus, the higher the ratio, the smaller would be the wax crystals because more nuclei give rise to smaller crystals; hence, for a given treat of additive, the CFPP depression below the cloud point would be greater.

In tests on a number of fuels, it has been shown that fuels that are difficult to treat with current commercial middle-distillate flow improvers (MDFI's) correspond to those characterised by characteristics (i) and (ii) of this invention.

Fuel oils with those characteristics are difficult to treat in the sense that they cannot readily be endowed with target cold flow performance, as measured by a CFPP depression of at least 10 deg. C., by use of existing additive technology, for example using 500 ppm by mass of an MDFI, which represents a working acceptable maximum treat rate.

Examples, and/or other examples, of fuel oils that are difficult to treat and to which this invention is applicable are as follows:

- Fuel oil comprising a middle-distillate fuel in admixture with a vegetable-based fuel. Examples of such vegetable-based fuel are fatty acid methyl esters ("FAME) which may, as a result of legislation and/or tax credits, be added to middle-distillate fuel to form so-called biodiesel. As examples of FAME's there may be mentioned rape seed methyl ester (RME) and palm oil methyl ester (PME). FAME's may include specific esters such as methyl stearate and methyl palmitate, all of which are found to separate with diesel fuel wax.
- Fuel oil comprising a middle-distillate fuel in admixture with a Fischer-Tropsch synthetic fuel. Fischer-Tropsch fuels are those made by firstly generating syngas ($CO+H_2$) and then converting the syngas to normal alkanes by a Fischer-Tropsch process. The normal alkanes may then be wholly or partially modified by processes such as catalytic cracking/reforming or isomerisation, hydrocracking and hydroisomerisation to yield a variety of hydrocarbons such as isoparaffins, cyclo-paraffins and aromatic compounds to give a Fischer-Tropsch fuel. As examples of Fischer-Tropsch fuels there may be mentioned gas-to-liquid (GTL), biomass-to-liquid (BTL) and coal conversion fuels.
- A middle-distillate fuel in admixture with a hydrocracked (or hydrotreated) vegetable fuel (HRO), such vegetable fuel being as described above.

To determine characteristics (i) and (ii) of fuel oils that include Fischer-Tropsch synthetic fuel, the mass %'s of n-alkanes contributed to the fuel oil by the Fischer-Tropsch fuel are added to the mass %'s of the n-alkanes contributed by the middle-distillate fuel, appropriately weighted. To determine characteristics (i) and (ii) of fuel oils that include FAME's, the mass % contribution of the fatty acid is added in the same way as above but after correlating the FAME with that n-alkane having the same melting point as the FAME. As examples, methyl palmitate has the same melting point (33° C.) as n-$C_{19}H_{40}$ and is therefore treated as if it were a $C_{19}$ n-alkane; and methyl stearate has the same melting point (41° C.) as n-$C_{21}H_{44}$ and is therefore treated as if it were a $C_{21}$ n-alkane. The basis of this is that these ester/n-alkane pairs have similar molecular weights and waxy nature and so are expected to have similar heats of crystallisation; thus, their solubilities will relate to their melting points. Methyl oleate has the same melting point (−5° C.) as n-$C_{13}H_{28}$ but which is ignored because it is too soluble to separate as wax.

Once the above adjustments have been made, characteristics (i) and (ii) may be calculated as for a non-blended hydrocarbon fuel oil.

The middle-distillate fuel oil referred to above is a petroleum-based fuel oil generally boiling within the range of from 110 to 500, e.g. 150 to 400 or 170 to 370° C. It may comprise atmospheric distillate or vacuum distillate, or a blend in any proportion of straight-run and thermally and/or catalytically cracked or hydrocracked distillate. The most common petroleum (middle-distillate) distillate fuels are kerosene, jet fuels, diesel fuels and heating oils. The heating oil may be a straight-run atmospheric distillate, or it may contain minor amounts, e.g. up to 35% by mass, of vacuum gas oil or cracked gas oil or both. Low temperature flow problems are most usually encountered in use of diesel fuels and heating oils.

Preferably, the middle-distillate fuel oil has a sulphur content of at most 0.2, especially of at most 0.5, % by mass. Middle-distillate fuel oils with even lower levels of sulphur are also suitable such as, those with less than 50, preferably less than 20, for example 10 or less, ppm by mass.

The vegetable-based fuel, the Fischer-Tropsch synthetic fuel or the hydrocracked vegetable fuel may constitute from 2 to 80, such as 5 to 80, preferably 5 to 50, more preferably 5 to 20, percent by mass of the fuel oil.

As a further example of a fuel oil to which this invention is applicable, there may be mentioned middle-distillate fuel oils containing 10 or less ppm by mass of sulphur, referred to above, when used above or with small or adventitious amounts (e.g. 2 or less than 2% by mass) of other fuel oils such as GTL or FAME. Such fuel oils, referred to as ultra-low sulphur fuel oils, may be made by desulphurisation processes that require limits to the fractions boiling higher than 350 or 330° C. (as such fractions are difficult to desulphurise). This results in sharp limits to the n-alkane distribution characteristics that makes them also difficult to treat in the sense of this specification.

Ethylene Polymer Additive

In formulae (I) and (II), it is preferred that each of $R^1$ and $R^2$ represents hydrogen.

In formula (I), it is preferred that $R^3$ represents an alkyl group having from 5 to 15 carbon atoms, such as a branched chain alkyl group having from 7 to 15 carbon atoms wherein particular preferred units of formula (I) are those derived from such monomers as 2-ethylhexanoate, vinyl neodecanoate and vinyl octanoate. In formula (II), it is preferred that $R^4$ represents a methyl group.

Preferably, the proportion of units of formula (I) in the or each ethylene polymer is from greater than 13 to 19, such as from 14 to 18, preferably from 15 to 17, mole percent.

Preferably, the total proportion of units of formula (I) and of formula (II) in the or each ethylene polymer is from 15 to 20, such as 16 to 18, mole percent.

As stated, units of formula (II) are optional, i.e. the invention may include embodiments in which the ethylene polymer contains no units of formula (II). The proportion of units of formula (II) in the each ethylene polymer may be 0 to 15; such as 0 to 10, especially 0 to 5, and more especially 2 to 5, mole percent.

The polymer has at least two different repeat monomer units, i.e., is derivable from at least two different monomers. When units of formula (II) are included, the polymer has at least three different repeat monomer units. Also included may be polymers derivable from four or more monomers. For example, the polymer may contain two or more different units of formulae (I) or (II), and/or may contain units of formula (III):

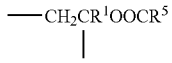

(III)

wherein $R^5$ represents a hydrocarbyl group having 5 or more carbon atoms other than one as defined by $R^3$.

As used in this specification the term "hydrocarbyl" refers to a group having a carbon atom directly attached to the rest of the molecule and having a hydrocarbon or predominantly hydrocarbon character. Among these, there may be mentioned hydrocarbon groups, including aliphatic, (e.g. alkyl), alicylic (e.g. cycloalkyl), aromatic, aliphatic and alicyclic-substituted aromatic and alicylic groups. Aliphatic groups are advantageously saturated. These groups may contain non-hydrocarbon subsituents provided their presence does not alter the predominantly hydrocarbon character of the group. Examples include 2-ketopropyl, ethoxyethyl, and propoxypropyl. The groups may also or alternatively contain atoms other than carbon in a chain or ring otherwise composed of carbon atoms. Suitable hereto atoms include, for example, nitrogen, sulphur, and, preferably, oxygen. Advantageously, the hydrocarbyl group contains at most 30, preferably at most 15, more preferably at most 10 and most preferably at most 8, carbon atoms.

The polymer may also contain units of formulae other than those mentioned above, for example units of the formula (IV)

$$—CH_2CHR^6—$$

where $R^6$ represents —OH, or of the formula (V)

$$—CCH_3(CH_2R^7)CHR^8— \quad (V)$$

where $R^7$ and $R^8$ each independently represent hydrogen or an alkyl group with up to 4 carbon atoms, the units (V) advantageously being derived from isobutylene, 2-methylbut-2-ene or 2-methylpent-2-ene.

Preferably, the number average molecular weight (Mn) of the at least one ethylene polymer is in the range of 2,000 to 10,000, more preferably 3,000 to 8,000, most preferably 4,000 to 7,000. In this specification Mn refers to that value measured by GPC, in comparison with polystyrene standards.

Preferably, the degree of branching of the at least one ethylene polymer is less than 8 such as less than 6, e.g. in the range of 2 to 5, more preferably 2 to 4, such as 2 to 3.5, methyl groups per 100 methylene units. The degree of branching of the polymer is the number of methyl groups per 100 methylene units, as measured by NMR and corrected for the number of methyl and methylene groups in $R^3$ or $R^4$ groups. Reference is made to FIG. 1 of EP 1 007 606 and the description thereof for an example of a calculation of the degree of branching. Details of the conditions used for the NMR determination of the degree of branching of the ethylene polymer will be known to those skilled in the art. For example, the skilled man is aware that poorly resolved NMR spectra should be avoided and will choose appropriate conditions. Generally, NMR spectra obtained from high frequency NMR instruments will be preferred. A suitable NMR solvent will be chosen to ensure both good signal resolution and to minimise interference between signals from the solvent and signals from the polymer. It is found that spectra obtained at about 40° C. from NMR instruments operating at 400 Mhz or greater using a solvent of deuterated chloroform are suitable. Both $^1H$ NMR and $^{13}C$ NMR experiments may be used if desired.

It is also within the scope of the invention to provide a composition comprising a mixture of two or more polymers according to the invention.

Additional Cold Flow Improved Additives

The present invention may comprise the presence of additional cold flow improver additives in the fuel oil composition such as other ethylene polymers with vinyl esters such as vinyl acetate. Their presence may lead to a further improvement in cold flow performance as measured by CFPP.

Other such additional additives are described and discussed below:

Comb polymers are polymers in which branches containing hydrocarbyl groups are pendant from a polymer backbone, and are discussed in "Comb-Like Polymers. Structure and Properties", N. A. Plate and V. P. Shibaev, J. Poly. Sci. Macromolecular Revs., 8, p 117 to 253 (1974).

Generally, comb polymers have one or more long chain hydrocarbyl branches, e.g., oxyhydrocarbyl branches, normally having from 10 to 30 carbon atoms, pendant from a polymer backbone, said branches being bonded directly or indirectly to the backbone. Examples of indirect bonding include bonding via interposed atoms or groups, which bonding can include covalent and/or electrovalent bonding such as in a salt.

Advantageously, the comb polymer is a homopolymer or a copolymer having at least 25 and preferably at least 40, more preferably at least 50, molar percent of the units of which have, side chains containing at least 6, and preferably at least 10, atoms.

As examples of preferred comb polymers there may be mentioned those of the general formula

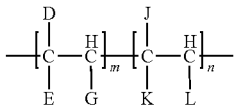

wherein D=$R^{11}$, $COOR^{11}$, $OCOR^{11}$, $R^{12}COOR^{11}$, or $OR^{11}$,

E=H, $CH_3$, D, or $R^{12}$,

G=H or D

J=H, $R^{12}$, $R^{12}COOR^{11}$, or an aryl or heterocyclic group,

K=H, $COOR^{12}$, $OCOR^{12}$, $OR^{12}$ or COOH,

L=H, $R^{12}$, $COOR^{12}$, $OCOR^{12}$, COOH, or aryl, $R^{11} \geq C_{10}$ hydrocarbyl, $R^{12} \geq C_1$ hydrocarbyl or hydrocarbylene, and m and n represent mole fractions, m being finite and preferably within the range of from 1.0 to 0.4, n being less than 1 and preferably in the range of from 0 to 0.6. $R^{11}$ advantageously represents a hydrocarbyl group with from 10 to 30 carbon atoms, while $R^{12}$ advantageously represents a hydrocarbyl or hydrocarbylene group with from 1 to 30 carbon atoms.

The comb polymer may contain units derived from other monomers if desired or required.

These comb polymers may be copolymers of maleic anhydride or fumaric or itaconic acids and another ethylenically unsaturated monomer, e.g., an α-olefin, including styrene, or an unsaturated ester, for example, vinyl acetate or homopolymer of fumaric or itaconic acids. It is preferred but not essential that equimolar amounts of the comonomers be used although molar proportions in the range of 2 to 1 and 1 to 2 are suitable. Examples of olefins that may be copolymerized with e.g., maleic anhydride, include 1-decene, 1-dodecene, 1-tetradecene, 1-hexadecene, and 1-octadecene.

The acid or anhydride group of the comb polymer may be esterified by any suitable technique and although preferred it is not essential that the maleic anhydride or fumaric acid be at least 50% esterified. Examples of alcohols which may be used include n-decan-1-ol, n-dodecan-1-ol, n-tetradecan-1-ol, n-hexadecan-1-ol, and n-octadecan-1-ol. The alcohols may also include up to one methyl branch per chain, for example, 1-methylpentadecanl-ol or 2-methyltridecan-1-ol. The alcohol may be a mixture of normal and single methyl branched alcohols. It is preferred to use pure alcohols rather than the commercially available alcohol mixtures but if mixtures are used the $R^{12}$ refers to the average number of carbon atoms in the alkyl group; if alcohols that contain a branch at the 1 or 2 positions are used $R^{12}$ refers to the straight chain backbone segment of the alcohol.

These comb polymers may especially be fumarate or itaconate polymers and copolymers such for example as those described in EP-A-153176, EP-A-153177, EP-A-225688 and WO 91/16407.

Particularly preferred fumarate comb polymers are copolymers of alkyl fumarates and vinyl acetate, in which the alkyl groups have from 10 to 20 carbon atoms, more especially polymers in which the alkyl groups have 12 carbon atoms or in which the alkyl groups are a mixture of $C_{12}/C_{14}$ alkyl groups, made, for example, by solution copolymerizing an equimolar mixture of the fumarate ester and vinyl acetate. When the mixture is used it is advantageously a 1:1 by weight mixture of normal $C_{12}$ and $C_{14}$ alcohols. Furthermore, mixtures of the $C_{12}$ ester with the mixed $C_{12}/C_{14}$ ester may advantageously be used. In such mixtures, the ratio of $C_{12}$ to $C_{12}/C_{14}$ is advantageously in the range of from 1:1 to 4:1, preferably 2:1 to 7:2, and most preferably about 3:1, by weight. The particularly preferred comb polymers are those having a number average molecular weight, as measured by vapour phase osmometry, of 1,000 to 100,000, more especially 1,000 to 30,000.

Other suitable comb polymers are the polymers and copolymers of α-olefins and esterified copolymers of styrene and maleic anhydride, and esterified copolymers of styrene and fumaric acid; mixtures of two or more comb polymers may be used in accordance with the invention and, as indicated above, such use may be advantageous. other examples of comb polymers are hydrocarbon polymers, e.g., copolymers of ethylene and at least one α-olefin, the α-olefin preferably having at most 20 carbon atoms, examples being n-decene-1 and n-dodecene-1. Preferably, the number average molecular weight of such a copolymer is at least 30,000 measured by GPC. The hydrocarbon copolymers may be prepared by methods known in the art, for example using a Ziegler type catalyst.

Preferably, the ratio of the amount of comb polymer to the amount of ethylene polymer in the additive composition is in the range from 1:99 to 99:1, more preferably in the range from 1:10 to 10:1, for example 1:1.

Other additives for improving low temperature properties include polar nitrogen compounds. Such compounds are oil-soluble polar nitrogen compounds carrying one or more, preferably two or more, substituents of the formula $>NR^{13}$, where $R^{13}$ represents a hydrocarbyl group containing 8 to 40 atoms, which substituent or one or more of which substituents may be in the form of a cation derived therefrom. The oil soluble polar nitrogen compound is generally one capable of acting as a wax crystal growth inhibitor in fuels. it comprises for example one or more of the following compounds:

An amine salt and/or amide formed by reacting at least one molar proportion of a hydrocarbyl-substituted amine with a molar proportion of a hydrocarbyl acid having from 1 to 4 carboxylic acid groups or its anhydride, the substituent(s) of formula $>NR^{13}$ being of the formula —N $R^{13}$ $R^{14}$ where $R^{13}$ is defined as above and $R^{14}$ represents hydrogen or $R^{14}$, provided that $R^{13}$ and $R^{14}$ may be the same or different, said substituents constituting part of the amine salt and/or amide groups of the compound.

Ester/amides may be used, containing 30 to 300, preferably 50 to 150, total carbon atoms. These nitrogen compounds are described in U.S. Pat. No. 4,211,534. Suitable amines are predominantly $C_{12}$ to $C_{40}$ primary, secondary, tertiary or quaternary amines or mixtures thereof but shorter chain amines may be used provided the resulting nitrogen compound is oil soluble, normally containing about 30 to 300 total carbon atoms. The nitrogen compound preferably contains at least one straight chain $C_8$ to $C_{40}$, preferably $C_{14}$ to $C_{24}$, alkyl segment.

Suitable amines include primary, secondary, tertiary or quaternary, but are preferably secondary. Tertiary and quaternary amines only form amine salts. Examples of amines include tetradecylamine, cocoamine, and hydrogenated tallow amine. Examples of secondary amines include dioctacedyl amine and methylbehenyl amine. Amine mixtures are also suitable such as those derived from natural materials. A preferred amine is a secondary hydrogenated tallow amine, the alkyl groups of which are derived from hydrogenated tallow fat composed of approximately 4% $C_{14}$, 31% $C_{16}$, and 59% $C_{18}$.

Examples of suitable carboxylic acids and their anhydrides for preparing the nitrogen compounds include ethylenediamine tetraacetic acid, and carboxylic acids based on cyclic skeletons, e.g., cyclohexane-1,2-dicarboxylic acid, cyclohexene-1,2-dicarboxylic acid, cyclopentane-1,2-dicarboxylic acid and naphthalene dicarboxylic acid, and 1,4-dicarboxylic acids including dialkyl spirobislactones. Generally, these acids have about 5 to 13 carbon atoms in the cyclic moiety. Preferred acids useful in the present invention are benzene dicarboxylic acids e.g., phthalic acid, isophthalic acid, and terephthalic acid. Phthalic acid and its anhydride are particularly preferred. The particularly preferred compound is the amide-amine salt formed by reacting 1 molar portion of phthalic anhydride with 2 molar portions of dihydrogenated tallow amine. Another preferred compound is the diamide formed by dehydrating this amide-amine salt.

Other examples are long chain alkyl or alkylene substituted dicarboxylic acid derivatives such as amine salts of monoamides of substituted succinic acids, examples of which are known in the art and described in U.S. Pat. No. 4,147,520, for example. Suitable amines may be those described above.

Other examples are condensates, for example, those described in EP-A-327427.

Further additives for improving low temperature properties are compounds containing a cyclic ring system carrying at least two substituents of the general formula below on the ring system $$-A-N\,R^{15}\,R^{16}$$

where A is a linear or branched chain aliphatic hydrocarbylene group optionally interrupted by one or more hetero atoms, and $R^{15}$ and $R^{16}$ are the same or different and each is independently a hydrocarbyl group containing 9 to 40 atoms optionally interrupted by one or more hetero atoms, the substituents being the same or different and the compound optionally being in the form of a salt thereof. Advantageously, A has from 1 to 20 carbon atoms and is preferably a methylene or polymethylene group. Such compounds are described in WO 93/04148.

Also suitable are hydrocarbon polymers. Examples are those of the general formula:

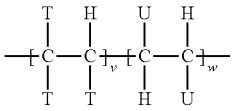

wherein T=H or $R^{21}$ wherein $R^{21}$=$C_1$ to $C_{40}$ hydrocarbyl, and

U=H, T, or aryl and v and w represent mole fractions, v being within the range of from 1.0 to 0.0, w being in the range of from 0.0 to 1.0.

The hydrocarbon polymers may be made directly from monoethylenically unsaturated monomers or indirectly by hydrogenating polymers from polyunsaturated monomers, e.g., isoprene and butadiene.

Examples of hydrocarbon polymers are disclosed in WO 91/11488.

Preferred copolymers are ethylene α-olefin copolymers, having a number average molecular weight of at least 1,000. Preferably the α-olefin has at most 28 carbon atoms. Examples of such olefins are propylene, butene, isobutene, n-octene-1, isooctene- 1, n-decene-1, and n-dodecene-1. The copolymer may also comprise small amounts, e.g., up to 10% by weight, of other copolymerizable monomers, for example olefins other than α-olefins, and non-conjugated dienes.

The number average molecular weight of the ethylene α-olefin copolymer is, as indicated above, preferably at least 1,000, as measured by gel permeation chromatography (GPC) relative to polystyrene standards, advantageously at least 1,500 and preferably at least 2,000.

Advantageously, the copolymer has a molar ethylene content between 50 and 95 percent. More advantageously, the ethylene content is within the range of from 60 to 90%, and preferably it is in the range from 65 to 90%; more preferably from 75 to 85%.

The copolymers may be prepared by any of the methods known in the art, for example using a Ziegler type catalyst or metallacene-type catalysts.

Alternatively, the hydrocarbon polymer may be an oil-soluble hydrogenated block diene polymer, comprising at least one crystallizable block, obtainable by end-to-end polymerization of a linear diene, and at least one non-crystallizable block, the non-crystallizable block being obtainable by 1,2-configuration polymerization of a linear diene, by polymerization of a branched diene, or by a mixture of such polymerizations. Both types of hydrocarbon polymer may also be used together.

Advantageously, the block copolymer before hydrogenation comprises units derived from butadiene only, or from butadiene and at least one comonomer of the formula $$CH_2{=}CR^{22}{-}CR^{23}{=}CH_2$$

wherein $R^{22}$ represents a $C_1$ to $C_8$ alkyl group and $R^{23}$ represents hydrogen or a $C_1$ to $C_8$ alkyl group. Advantageously the total number of carbon atoms in the comonomer is 5 to 8, and the comonomer is advantageously isoprene. Advantageously, the copolymer contains at least 10% by weight of units derived from butadiene.

In general, the crystallizable block or blocks will be the hydrogenation product of the unit resulting from predominantly 1,4- or end-to-end polymerization of butadiene, while the non-crystallizable block or blocks will be the hydrogenation product of the unit resulting from 1,2-polymerization of butadiene or from 1,4-polymerization of an alkyl-substituted butadiene.

In one embodiment of the invention, the additional cold flow improves additives exclude one or more polyoxyalkylene compounds.

A concentrate comprising the additive of this invention in admixture with a suitable solvent is convenient as a means for incorporating the additive into fuel oil, which incorporation may be done by methods known in the art. The concentrates may also contain other additives as required and preferably contain from 3 to 75, more preferably 3 to 60, most preferably 10 to 50, wt % of the additives, preferably soluble in oil. Examples of solvent are organic solvents including hydrocarbon solvents, for example petroleum fractions such as naphtha, kerosene, diesel and heater oil; aromatic hydrocarbons such as aromatic fractions, e.g. those sold under the 'SOLVESSO' tradename; alcohols and/or esters; and paraffinic hydrocarbons such as hexane and pentane and isoparaffins. The solvent must, of course, be selected having regard to its compatibility with the additive and with the fuel oil.

Oil Composition

The fuel oil composition of the invention advantageously contains an additive of the invention in a proportion of 0.0005 to 1, advantageously 0.001 to 0.1, and preferably 0.01 to 0.06, by mass, based on the mass of fuel oil.

EXAMPLES

The invention will now be described in the following examples which are not intended to limit the scope of the claims hereof.

Additives

Two additives were obtained or prepared for testing by methods generally described in the art, the additives being:

1: An ethylene: vinyl acetate: vinyl 2-ethylhexanoate terpolymer containing 2 mole percent of vinyl acetate and 16 mole percent of vinyl 2-ethylhexanoate.

A: An ethylene: vinyl acetate: vinyl 2-ethylhexanoate terpolymer containing 3 mole percent of vinyl acetate and 11 mole percent of vinyl 2-ethylhexanoate.

Additive 1 is for use in the present invention, whereas Additive A is for reference purposes.

Fuel Oil Compositions and Testing

Example 1

Additives 1 and A were blended, in various proportions, into a fuel oil that comprised a middle-distillate fuel having a sulphur content of 10 ppm in admixture with 20 mass % of a Fischer-Tropsch synthetic fuel to provide a set of fuel oil compositions. The fuel oil had an n-alkane distribution curve whose gradient ("Gradient") from C18 to C26 was −0.60, and a ratio ("Ratio") of n-alkanes of greater than C22 to n-alkanes from C18 to C21 of 0.084.

The cold flow properties of each fuel oil composition was measured by the cold filter plugging point (CFPP) test as described in the Coley, T., et al., entitled: "New Laboratory Tests for Predicting Low Temperature Operability of Diesel Fuel", *Journal of the Institute of Petroleum,* 52 No. 510 (1966), 173-189. The results are summarised below wherein the numerical column headings are Additive treat rates in ppm by mass, wherein the Additve contains 75% by mass of polymer.

| Additive | 300 | 400 | 500 |
|---|---|---|---|
| 1 | −16.5 | −22.4 | −23.5 |
| A | −14.5 | −16.5 | −17.0 |

The above results are expressed in ° C., wherein a lower value indicates a better cold flow performance. The results show that the cold flow performance of Additive 1, representing the present invention, is significantly better than that of the reference additive, Additive A, in that it achieves the target CFPP of −20° C. at lower treat rates.

Example 2

Each of Additives 1 and A were blended, in various proportions, into a fuel oil comprising a middle-distillate fuel oil having a sulphur content of 10 ppm by mass, to provide a set of fuel oil compositions. The n-alkane distribution curve of the fuel oil had a Gradient of −0.46 and a Ratio of 0.110.

The CFPP of each composition was measured as described in Example 1. The results are summarised below where the numerical column headings are Additive treat rates in ppm by mass, wherein the Additive contains 75% by mass of polymer.

| Additive | 300 | 350 | 400 | 450 | 500 | Average |
|---|---|---|---|---|---|---|
| 1 | −21 | −20 | −23.5 | −22.25 | −21.88 | −21.7 |
| A | −17.5 | −18.5 | −18 | −18 | −19 | −18.0 |

The results show that Additive 1 is much more effective than the reference additive, Additive A, in achieving the target CFPP temperature of −20° C.

Example 3

Example 2 was repeated but wherein the fuel oil composition additionally contained 150 ppm by mass of a commercially-available wax anti-setting additive. The results are summarised below wherein the column headings are as in Example 2.

| Additive | 300 | 350 | 400 | 450 | 500 | Average |
|---|---|---|---|---|---|---|
| 1 | −22 | −26.13 | −25.95 | −26.38 | −26 | −25.6 |
| A | −21.5 | −24 | −22 | −25 | −26.5 | −23.1 |

The target CFPP temperature for the fuel oil composition was −25° C. The results show that Additive 1 is much more effective than the reference additive, Additive A, in attaining that target.

Example 4

The procedure of Example 2 was repeated but employing, as fuel oil, the middle-distillate fuel in admixture with 5 mass % of rape seed methyl ester (RME); and that fuel oil containing 150 ppm of a commercial wax anti-settling additive (WASA). The n-alkane distribution curve of the fuel oil had a Gradient of −0.66 and a Ratio of 0.098. The results are summarised below:

| | | Additive Treat (ppm by mass)* | | | |
|---|---|---|---|---|---|
| Fuel | Additive | 350 | 400 | 500 | 600 |
| +RME | 1 | −20 | −20.5 | | |
| | A | | −18 | −18.5 | |
| +RME | 1 | −25.5 | −27.5 | | |
| +WASA | A | | −18.5 | −20.5 | −23.5 |

*Additive contains 75% by mass of polymer.

The results show that

The RME-containing fuel was more difficult to treat using the reference additive rather than Additive 1

Additive 1 was more effective than the reference additive in treating the WASA-containing fuel.

What is claimed is:

1. A fuel oil composition comprising:

(A) a fuel oil in a major amount, which fuel oil has a mass % against n-alkane carbon number distribution curve, wherein n-alkane includes any ester in the oil having the same melting point as an n-alkane, characterized by:

(i) a gradient from carbon number 18 to carbon number 26 that is less than −0.30; and (ii) a ratio of the mass of n-alkanes of carbon number greater than 22 to the mass of n-alkanes from carbon number 18 to carbon number 21 that does not exceed 0.25; and (B) an additive in a minor amount, consists essentially of at least one ethylene polymer which, in addition to units derived from ethylene, consists of units of the formula (I):

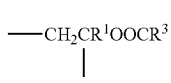

(I)

wherein $R^1$ represents hydrogen or methyl; $R^3$ represents a branched chain alkyl group having from 7 to 15 carbon atoms; and wherein the proportion of units of formula (I) in the ethylene polymer is greater than 13 and not greater than 20 mole percent.

2. The composition according to claim 1, wherein the fuel oil comprises a middle-distillate fuel in admixture with at least one of a vegetable-based fuel, a Fischer-Tropsch synthetic fuel, and a hydrocracked vegetable fuel.

3. The composition according to claim 1, wherein the fuel oil comprises a middle-distillate fuel having 10 ppm by mass or less of sulphur, expressed as atoms of sulphur.

4. The composition according to claim 1, wherein $R^1$ represents hydrogen.

5. The composition according to claim 1, wherein the proportion of units of formula (I) in the ethylene polymer is from greater than 13 to not greater than 19 mole percent.

6. The composition according to claim 1, wherein the number average molecular weight of the ethylene polymer is in the range from 2,000 to 10,000.

7. The composition according to claim 1, further comprising one or more additional cold flow improvement additives.

* * * * *